US005230194A

United States Patent [19]

McClure

[11] Patent Number: 5,230,194

[45] Date of Patent: Jul. 27, 1993

[54] INTERLOCKING BUILDING BLOCK

[76] Inventor: William L. McClure, Rte. 2 Box 192B, Midville, Ga. 30441

[21] Appl. No.: 713,870

[22] Filed: Jun. 12, 1991

[51] Int. Cl.[5] ..... E04C 1/00

[52] U.S. Cl. ..... 52/589; 52/593; 52/594; 52/606

[58] Field of Search ..... 52/309.12, 562, 563, 52/606, 439, 259, 593, 594, 589, 603, 605

[56] References Cited

U.S. PATENT DOCUMENTS

| | | | |
|---|---|---|---|
| 948,752 | 2/1910 | Wightman | 52/606 |
| 1,131,437 | 3/1915 | Stockman | 52/606 X |
| 1,813,912 | 7/1931 | Clark | 52/606 |
| 2,736,188 | 2/1956 | Wilheim | 52/606 X |
| 3,410,044 | 11/1968 | Moog | 52/439 X |
| 3,552,076 | 1/1971 | Gregori | 52/309.12 |
| 4,004,385 | 1/1977 | Kosuge | 52/439 |
| 4,301,637 | 11/1981 | Anderson | 52/594 |
| 4,510,724 | 4/1984 | Magnuson . | |
| 4,627,209 | 12/1986 | Schwartz | 52/589 |
| 4,651,485 | 3/1987 | Osborne . | |
| 4,719,737 | 1/1988 | Swart . | |
| 4,854,103 | 8/1989 | Klym | 52/593 |

*Primary Examiner*—Richard E. Chilcot, Jr.
*Attorney, Agent, or Firm*—Terry M. Gernstein

[57] ABSTRACT

A construction block includes two sides connected by webs that are sized and spaced to define uniform center-to-center distances when a plurality of blocks are interconnected. The block includes webs that are offset by a specific distance both from the ends of the block and from the top and bottom edges of that block. The spacing and sizing is selected to accommodate standard lumber sizes, including 2×4, 2×6 and 2×8 inches. Right and left corner blocks are also disclosed and can be used in conjunction with the block to form a building wall. A cap is also disclosed. All blocks can be interconnected to superadjacent and subadjacent blocks by a special double shoulder rabbet joint connection.

11 Claims, 6 Drawing Sheets

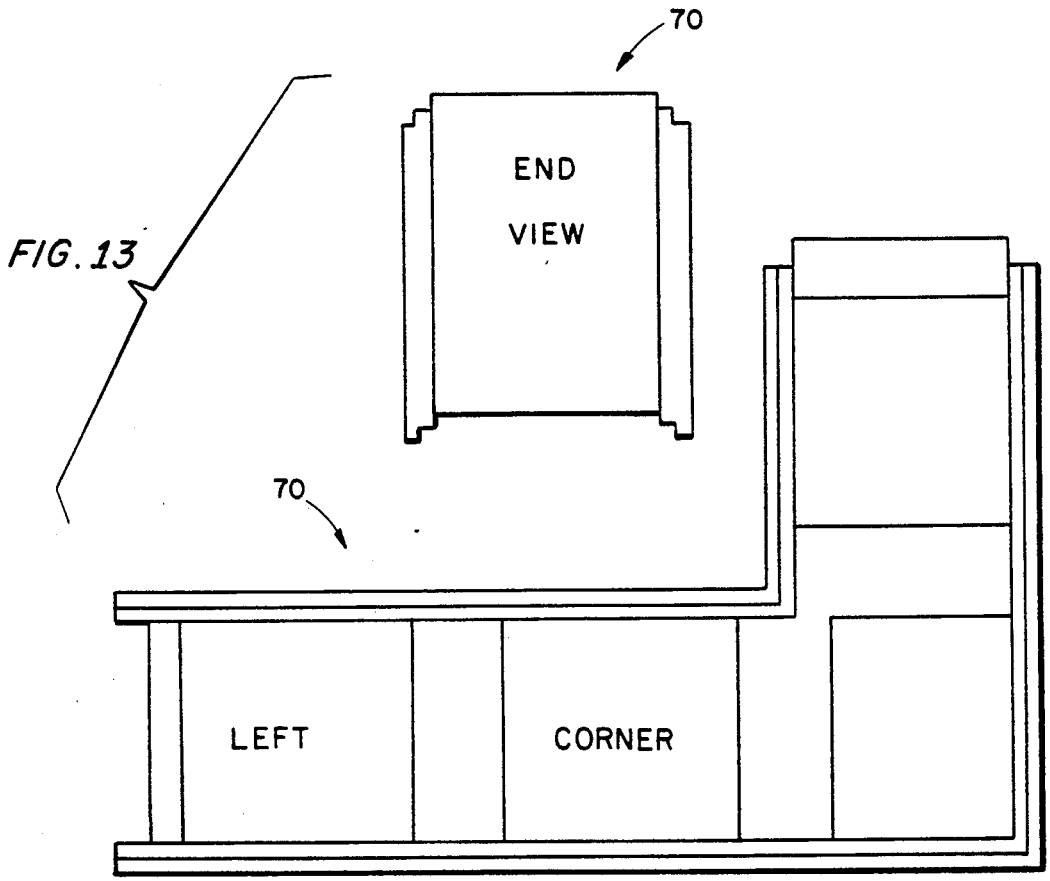
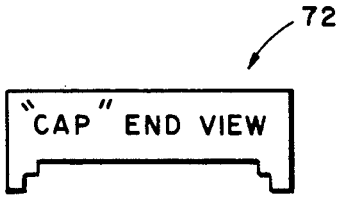
FIG. 14

INTERLOCKING BUILDING BLOCK

TECHNICAL FIELD OF THE INVENTION

The present invention relates to the general art of building materials, and to the particular field of construction blocks.

BACKGROUND OF THE INVENTION

The building industry has included elements that can be combined to form an overall structure. These elements include pre-formed elements, pre-cut elements, pre-assembled elements and the like. While quite handy, many of these elements are not versatile enough to accommodate a wide range of building configurations, applications, or a wide range of environmental conditions. Still further, many of these pre-prepared elements may not be easily installed by unskilled labor. Some of the pre-prepared elements even require special tools. In some instances, modifying a pre-prepared element to fit a particular application may require as much skill and time as simply fabricating the element on site.

Still further, it is often desirable to combine a pre-prepared element with standard lumber, such as 2×4, 2×6 or 2 ×8 standard boards. Many pre-assembled units must be modified if one or more standard lumber sizes are used. This is especially true of many such pre-prepared elements when insulation or finish panels are to be attached to the element.

Still further, many presently available pre-assembled elements cannot be combined beyond certain building sizes. For example, it may not be possible to extend a building beyond a certain height with some pre-assembled building elements. Many pre-assembled elements cannot be modified to increase the insulation factors associated therewith or to increase the fire retardant and fire resistant characteristics associated therewith. This reduces the desirability of many such elements.

Still further, many of the presently-available pre-assembled elements are not easily transported from one site to another, and are not conveniently stored on the building site.

Therefore, there is a need for a pre-assembled building element that is versatile, can accommodate various building and environmental factors and can be easily transported and stored, and can still be easily modified and combined with other building elements on the job site without the need of special tools or special skills.

OBJECTS OF THE INVENTION

It is a main object of the present invention to provide a pre-assembled building element that is versatile, can accommodate various building and environmental factors.

It is another object of the present invention to provide a pre-assembled building element that is versatile, can accommodate various building and environmental factors and can be easily transported and stored.

It is another object of the present invention to provide a pre-assembled building element that can be easily modified and combined with other building elements on the job site, without the need of special tools or special skills.

SUMMARY OF THE INVENTION

These, and other, objects are achieved by an interlocking building block that has two parallel and spaced apart sides with three webs interconnecting the sides.

The webs and the sides are sized and spaced to be extremely adaptable to a wide range of jobs, and job applications. The block is formed of wood particles, flakes, or chips that are chemically bound together by binder that has suitable characteristics whereby the overall block has suitable heat transfer and fire retardant characteristics.

The blocks are all uniform, so they can be combined, and are sized and configured to be amenable to a wide variety of applications. Specifically, the blocks include a basic block that is rectangular in configuration, a right corner, a left corner and a T-shape. The corner and T-shaped blocks are formed to combine with the basic block so a building can be formed of the blocks.

The webs of the blocks are offset with respect to both the longitudinal centerline and the transverse centerline of the block, and the offset distance is selected so the center-to-center distance between webs in a plurality of combined blocks is uniform, and equal to one-half the overall length of the block as measured along the longitudinal centerline of the block. The webs are offset with respect to the longitudinal centerline by an amount equal to the offset distance with respect to the transverse centerline. The web thickness is also selected to be a multiple of the offset distance so uniform blocks are provided.

The blocks also include a special connection means to securely lock one block to a superadjacent block and to a subadjacent block. This special connection means will be referred to hereinafter as a "double shoulder rabbet joint fastening means." While the connection means will be referred to in such terms, no limitation or association with a conventional rabbet joint is intended, and applicant notes that the joint is not intended to be a conventional rabbet joint. The double shoulder rabbet joint is unique to the blocks embodying the present invention. The connection means of the present invention is located on the top and on the bottom of each block so one block can be securely locked to an adjacent block using the fastening means. Suitable adhesive can be located in the fastening means to securely hold the blocks together and to provide further insulation properties to the assembled blocks.

The blocks also include spaces between the webs, so that once assembled, electrical lines, plumbing and insulation can be placed inside the blocks. Still further, the blocks are sized to accept either standard 2×4 lumber, standard 2×6 lumber or standard 2×8 lumber, and can also be used in conjunction with wall board, or the like.

BRIEF DESCRIPTION OF THE DRAWING FIGURES

FIG. 13 is a top plan and end view of a wide block.

FIG. 14 is a top plan view of a cap for use with a wide block such as illustrated in FIG. 13.

DETAILED DESCRIPTION OF THE PREFERRED EMBODIMENT OF THE INVENTION

Figure 1:
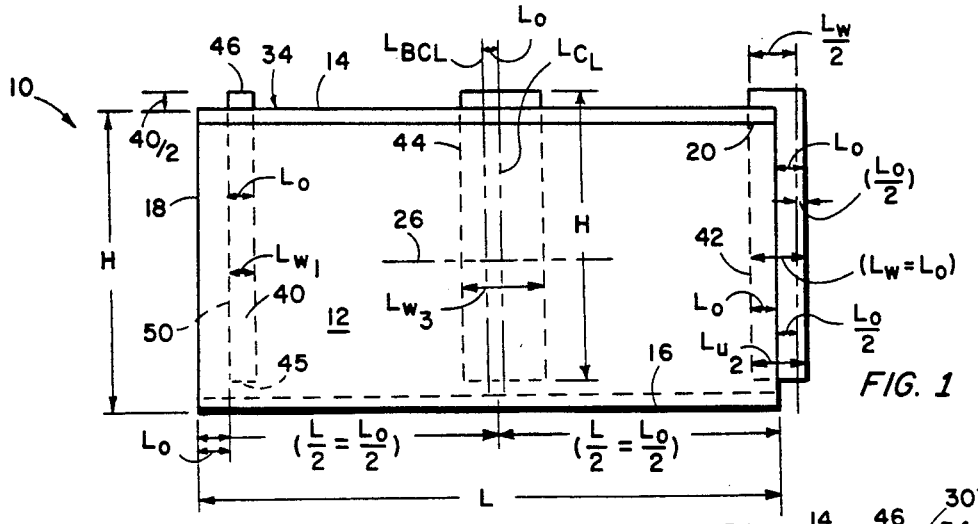
FIG. 1 is a side elevational view of a standard interlocking construction block of the present invention.
Figure 2:
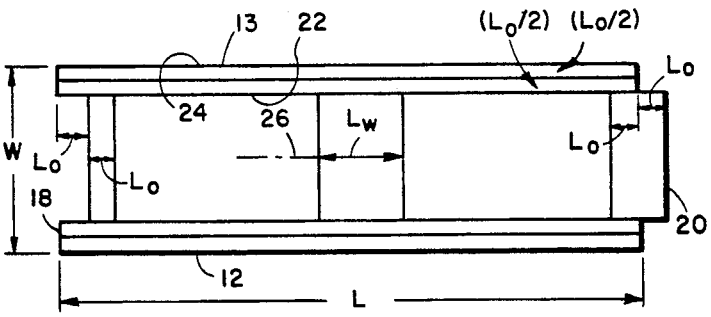
FIG. 2 is a top plan view thereof.
Figure 3:
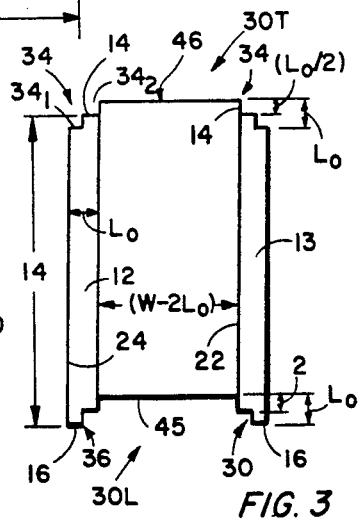
FIG. 3 is an end elevational view thereof.

Shown in FIGS. 1-3 is an interlocking building block 10 embodying the present invention. The block 10 includes two identical planar sides 12 and 13 that are parallel with each other and are spaced apart from each other. Each of the sides also includes a top edge 14, a bottom edge 16, a first end 18 and a second end 20. The side top edges are all co-planar with each other and the ends are also co-planar with corresponding ends of the other side as indicated in the figures. Each side further includes an inner surface 22 and an outer surface 24. Each side further includes a longitudinal centerline 26 extending between the ends 18 and 20' and a transverse centerline $L_{BCL}$ extending between the top and bottom edges. The block has an overall width W measured between the side outer surfaces 24, and a height H measured between the side top and bottom edges, measured along the block transverse centerline $L_{BCL}$.

Adjacent blocks are connected together by block connecting means. The block connecting means includes a double stepped rabbet joint connection means that connects a block to a superadjacent block via connection portion 30T, and to a subadjacent block via connection portion 30L in a securely interconnecting manner. The connection means includes a projection forming element 34 on each side top edge and a groove forming element 36 on each side bottom edge. The projection forming element of one block is received in the groove forming element of an adjacent block to interlock the two blocks together. Suitable adhesive, such as building adhesive, can be inserted into the groove to further secure the projection forming elements thereto in a sealed and weather-tight manner.

The block 10 further includes three webs, a first web 40 located adjacent to the block sides first ends 18, a second web 42 located adjacent to the block sides second ends 20 and a third web 44 located between the first and second webs. The webs span the space between the sides and connect at each end to an inner surface of the sides. The webs thus interconnect the sides together. Each of the webs has a bottom end 45 and a top end 46, with the web bottom ends all being co-planar with each other, and the web top ends all being co-planar with each other. The third web further includes a longitudinal centerline $L_{CL}$ extending between the top and bottom ends of that web.

The block 10 is sized and configured to be amenable to various formats and to accommodate various building configurations. The block 10 is standard and thus can be used in such various situations and needs only minor modification to accommodate a wide variety of buildings. The modification that is needed, can usually be carried out by unskilled labor using only standard tools. Furthermore, once the blocks are assembled, insulation, wiring and plumbing can be easily inserted, while finish products, such as wallboard or the like can also be easily attached to the blocks. The blocks are sized to accept standard lumber sizes, including both 2×4 and 2×6 lumber size.

The block has an overall length measured along the longitudinal centerline of L, while the webs have a width measured along the block longitudinal centerline of $L_{W1}$, $L_{W2}$ and $L_{W3}$ respectively. The first web 40 is offset along the block longitudinal centerline from the side ends 18 by a distance equal to $L_0$, so the first side 50 thereof is spaced from the side first sides 18 by the distance $L_0$. Each of the webs is offset along the block transverse centerline from the bottom edges by a distance equal to $L_0/2$, and the webs have a length measured along the web longitudinal centerline equal to the height, H, of the block so the web top ends are also spaced above the side top edges by a distance equal to $L_0/2$.

The first web has a width equal to $L_0$, the second web has a width equal to $2L_0$, and the third web has a width equal to $3L_0$. The second web is offset so that its longitudinal centerline is co-planar with the side ends 20. The offset positioning of the webs is indicated in FIG. 1 so that the third web 44 has its centerline $L_{CL}$ spaced from the side first end 18 a distance along the longitudinal centerline of the block equal to $(L/2+L_0/2)$, and spaced from the side second end 20 by a distance equal to $(L/2-L_0/2)$.

The particular spacing and sizing of the webs based on the offset distance, $L_0$, produces a standard block that will, when interconnected with adjacent blocks, have all webs equal sized, and equally spaced apart by a distance equal to L/2. This provides a uniform, and versatile structure.

As can also be seen in FIGS. 1, 2 and 3, the projection forming elements and groove elements are also sized according to the offset distance $L_0$. Thus, as indicated in FIGS. 2 and 3, the projection forming elements 34 includes two shoulders $34_1$ and $34_2$ that have heights measured along the block transverse centerline equal to $L_0/2$ and widths as measured from the side outer surface to the side inner surface equal to $L_0/2$. The groove section has similar shoulders $36_1$ and $36_2$ that are mirror images of the projection forming element shoulders. Since the webs extend above the side top edges by a distance equal to $L_0/2$, the webs will snugly interlock with the shoulders of the grooves. As indicated in FIG. 3, the webs have a width measured between the side inner surfaces equal to $(W-2L_0)$.

The preferred form of the block 10 has the following dimensions: L=16 inches; $L_0\frac{3}{4}$ inches; W=5 inches; and H=8 inches. With such dimensions, the block 10 can accept a 2×4 between adjacent webs, and a 2×6 fixed to the outer surfaces of the co-planar side ends 18 and/or 20. When a 2×6 is attached to the block and has the width dimension thereof extending along the width dimension of the block, with one side of the 2×6 flush with the outer surface of one of the sides, the 2×6 will overlap the other side outer surface. This overlap will serve as a shoulder against which drywall or the like can abut.

Figure 4:
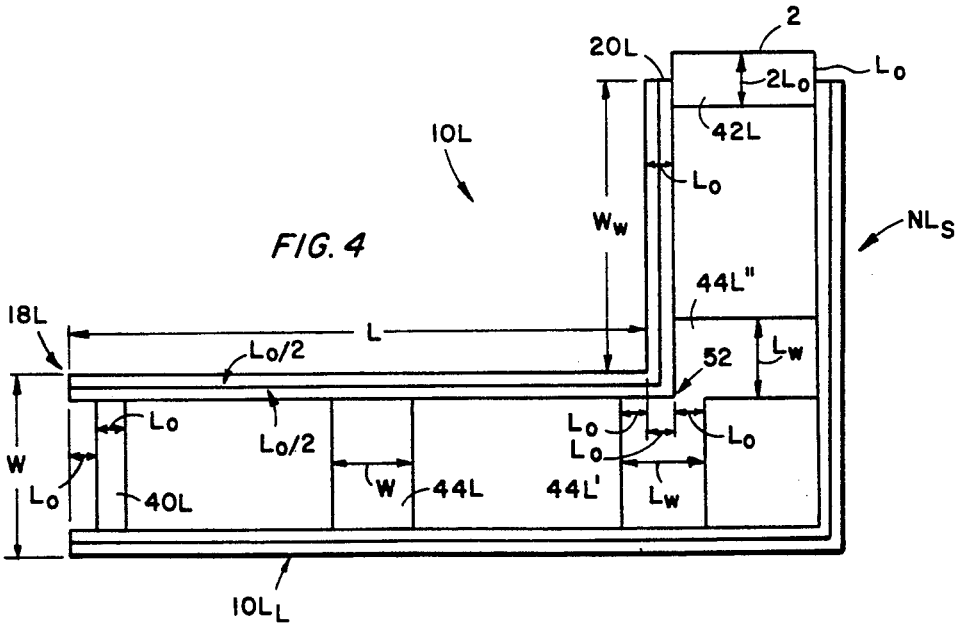
FIG. 4 is a top plan view of a left corner interlocking construction block of the present invention.
Figure 5:
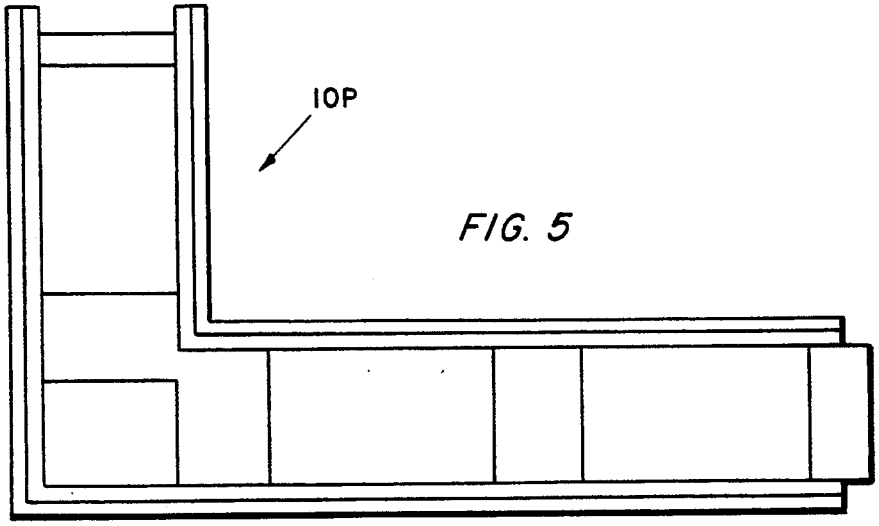
FIG. 5 is a top plan view of a right corner interlocking construction block of the present invention.

Two corner blocks are shown in FIGS. 4 and 5, with left corner block 10L being shown in FIG. 4 and right corner block 10R being shown in FIG. 5. The left corner block 10L is L shaped and includes a long leg $10L_L$ and a short leg $10L_S$. The legs of the block include double shoulder rabbet joint fastening means similar to that discussed above in reference to block 10, and therefore such means will not be discussed. The webs of the corner blocks 10L and 10R are offset a distance $L_0$ from the first ends of the block as discussed above, and the block long legs include two webs 44L and 44L' that have widths equal to $3L_0$, with web 44L' being offset beyond corner 52 formed at the intersection of the short leg and the long leg, by a distance equal to $L_0$. The short leg includes two webs 44L'' and 42L, with the web 44L'' having a width equal to $3L_0$ and the web 42 having a width equal to $2L_0$ as discussed above with regard to block 10. The web 42L is offset from the ends 20L of the block short leg, while a web 40L having a width equal to $L_0$ is offset from ends 18L by a distance equal to $L_0$.

In this manner, a block 10 can be connected to the block 10L at either end of either block and the center-to-center distance of the webs will remain equal to L/2, and the connected blocks can be set up as a corner configuration in a building wall.

Figure 11:
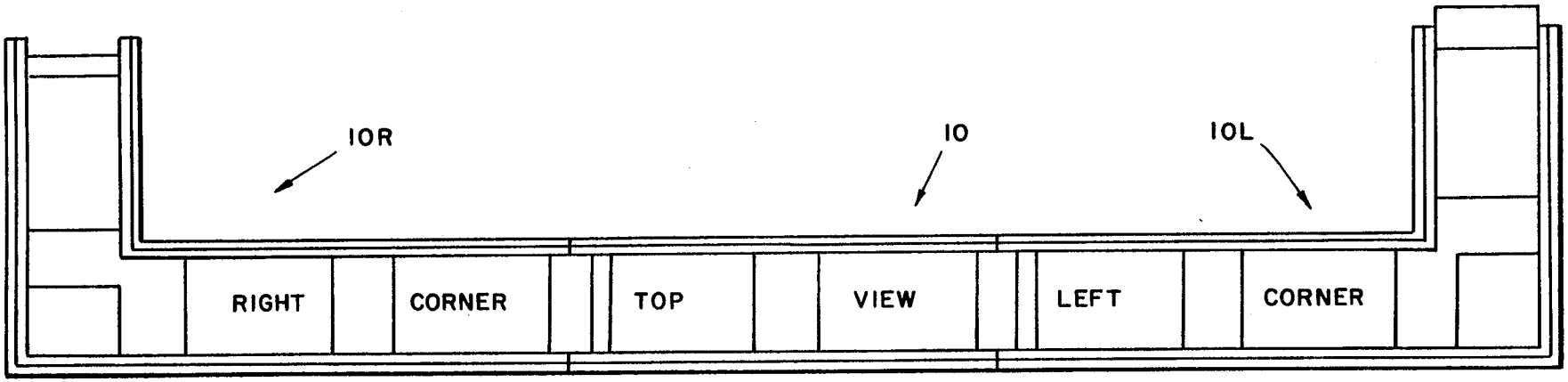
FIG. 11 is a top plan view of the FIG. 1, FIG. 4 and FIG. 5 blocks in combination with each other as a level in a building.

The right corner block 10R shown in FIG. 5 is similar to the block 10L just discussed. Therefore, the block 10R will not be specifically discussed. The blocks 10, 10L and 10R can all be interconnected with each other by connecting end 18 of one block with end 20 of an adjacent block. The double shoulder rabbet joint connection means of the blocks will line up and form a continuous fastener means in the connected blocks, and blocks can be connected on top and on bottom of the end-connected blocks to form a wall or like building structure. The blocks of one row can also be offset with respect to the blocks of the superadjacent and subadjacent rows as is usual to the building art. A system of blocks is shown in FIG. 11 illustrating the connection of blocks 10, 10L and 10R. A plurality of layers can be used to erect building wall. The connected blocks can be cut or formed to define openings for doors and windows. Alternatively, the blocks can be connected together in a pattern that will leave room for such openings. Those skilled in the art will understand how to effect this combination of blocks based on the teaching of the present disclosure.

Figure 9:
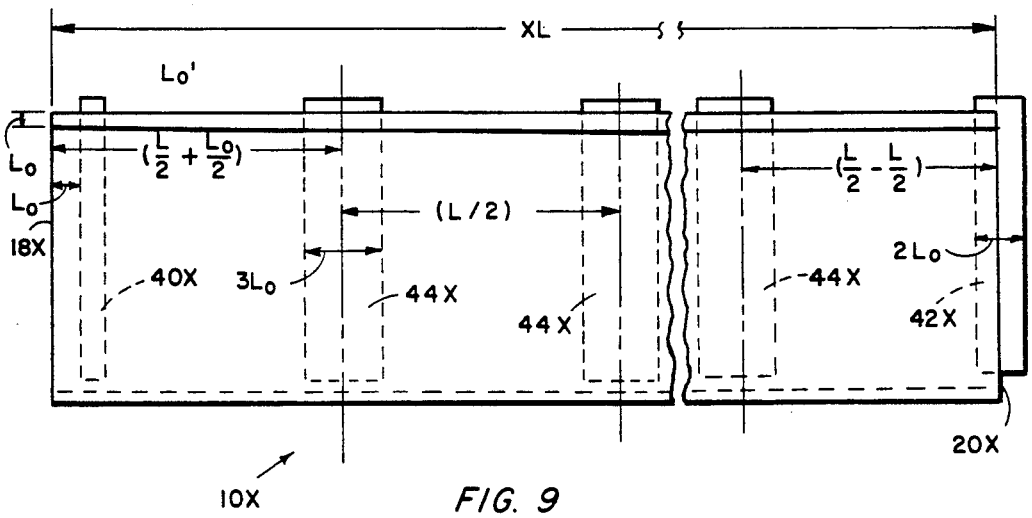
FIG. 9 is a side elevational view of another form of the interlocking building block of the present invention.
Figure 10:
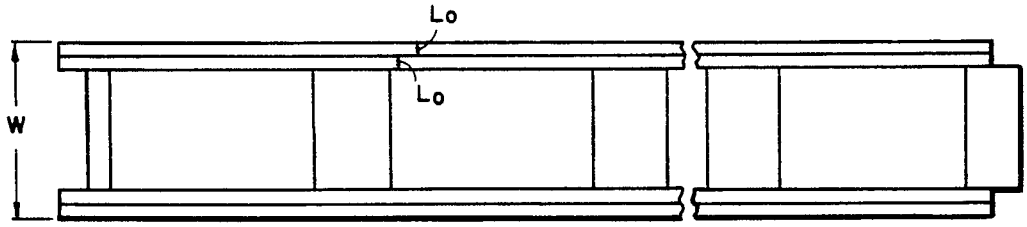
FIG. 10 is a top plan view of the block shown in FIG. 9.

If desired, the blocks can be longer than the block 10 whereby further building structures can be formed. Thus, as illustrated in FIGS. 9 and 10, a block 10X is similar to block 10 except that block 10X has a length equal to XL, and several webs 44X. The webs 44X have widths equal to $3L_0$, and are spaced apart from each other by a distance equal to L/2. As discussed above, the webs are all offset along the longitudinal centerline of the block a distance equal to $L_0$ so that end webs 40X and 42X are offset by the distance $L_0$, and the block ends 18X are spaced from the centerline of web 40X by a distance equal to $L_0$, and from the centerline of the adjacent web 44X by a distance equal to $(L/2+L_0/2)$, with ends 20X being spaced from the centerline of adjacent block 44X by a distance equal to $(L/2-L_0/2)$. As before, web 40X has a width equal to $L_0$, and web 42X has a width equal to $2L_0$ so when two blocks 10X are connected to each other or block 10X is connected to one of the corner blocks, the center-to-center spacing between webs is equal to L/2. In a preferred form of the block 10X, the length is equal to 32 inches or to 48 inches so the block is two or three times the length of the standard block 10.

Figure 6:
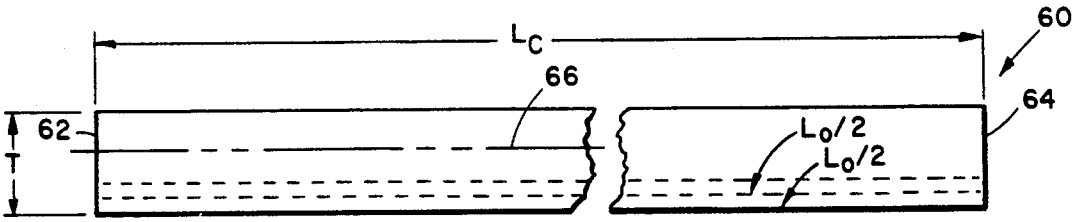
FIG. 6 is a side elevational view of a cap for use in conjunction with the interlocking construction block of the present invention.
Figure 7:
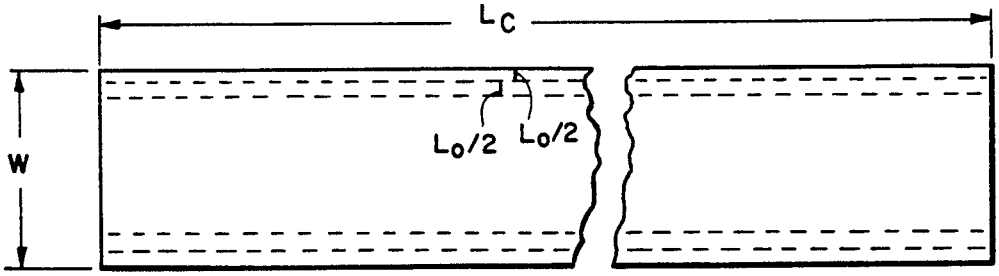
FIG. 7 is a top plan view of the cap shown in FIG. 6.
Figure 8:
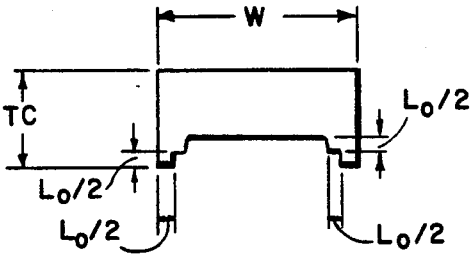
FIG. 8 is an end elevational view of the cap shown in FIG. 6.

A top layer of interconnected blocks should have the top thereof closed to provide a solid and level surface to which ceiling or floor joists can be secured and to prevent rain or other such environmental factor from entering the blocks. A closure cap 60 is illustrated in FIGS. 6, 7 and 8. In the preferred form of the invention, the cap is an integral component of the overall system. The cap also can be used to provide a solid, level surface to support and fasten door and window headers. Yet another function of the cap is to raise the door headers so the header will be even with the tops of adjacent blocks. Still another function of the cap is to raise the door header so the required height will be maintained for a pre-hung door unit. The cap 60 has a first end 62 that corresponds to the block first ends, a second end 64 that corresponds to the block second ends and a longitudinal centerline 66 extending between the two cap ends. The cap has a length measured along the cap longitudinal centerline equal to $L_C$ that is a multiple, including a fraction, of the length of the block 10, 10L or 10R. In one form, the cap length equals 96 inches. The cap also has a width W that equals the width of the blocks, and a groove means 36 that is identical to the groove means on the blocks and thus matches the connection means of the blocks so the cap can be snugly engaged on top of the projection means of a block or a series of interconnected blocks.

The cap has a thickness TC, and is preferably formed of a weather-resistant material, including metal or pressed board similar to the material used to form the blocks. In the preferred form, thickness TC is equal to 2½ inches.

Figure 12:
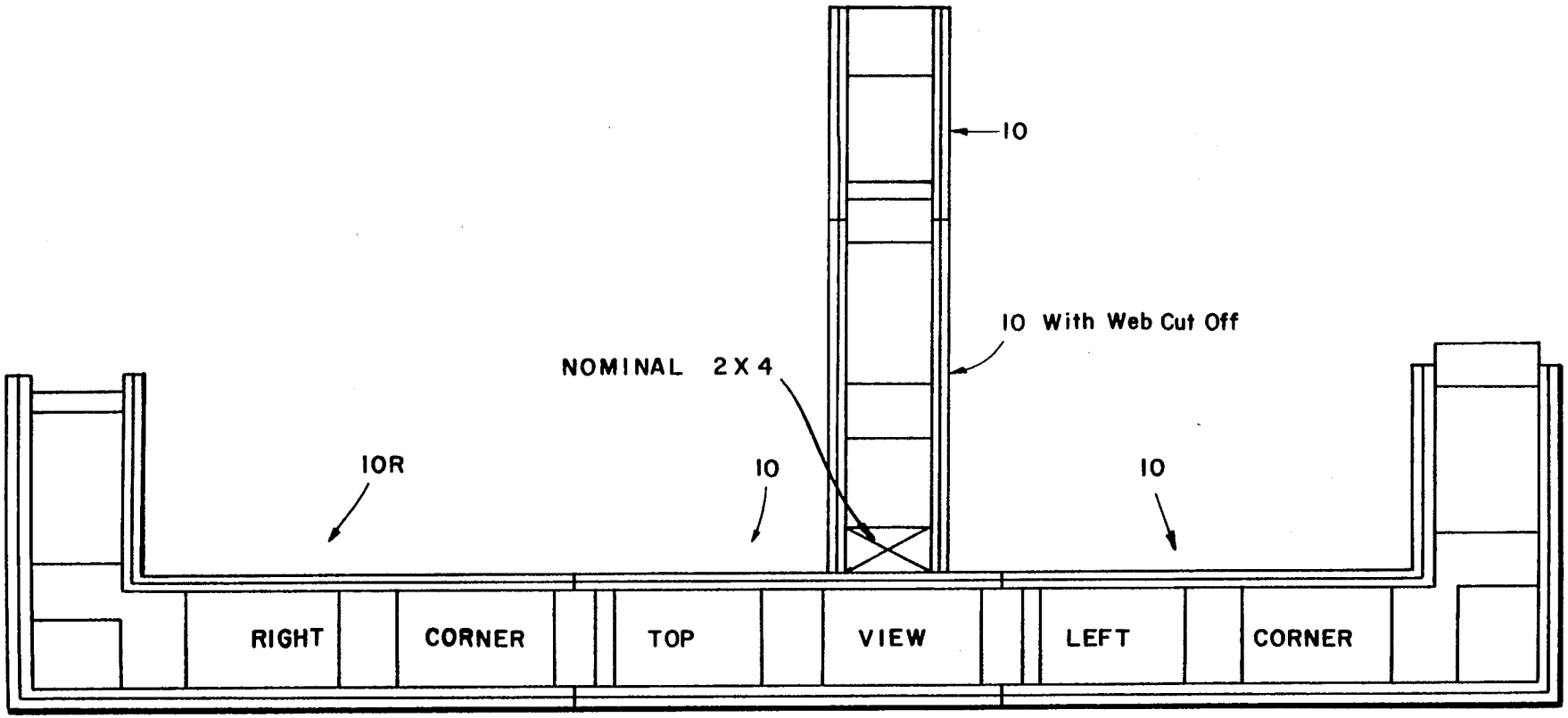
FIG. 12 is a top plan view of a T-shaped formation.

FIG. 12 illustrates a T-shaped formation formed by two corner blocks and a plurality of straight blocks. A cap can also be included. This permits any configuration of building structure to be achieved. For instance, if a tee is to be formed at any point along a previously erected wall of blocks, all that is required is to nail a vertical 2×4 at the desired position, cut a web off of a standard block, insert adhesive on the edges of the 2×4, snug the block over the 2×4 and the tee construction is formed.

An extra wide block 70 is shown in FIG. 13, and a cap 72 therefor is shown in FIG. 14. The dimensions and the relations thereof for block 70 are similar to the above-discussed blocks, except that the webs are 5½" wide, the outside of the left and right corners are 16" on the short leg and 23" on the long leg. The cap 72 is 5½" inside and 7" on the outside. The extra wide block 70 is thus compatible with standard 2×6 and 2×8 lumber.

It is understood that while certain forms of the present invention have been illustrated and described herein, it is not to be limited to the specific forms or arrangements of parts described and shown.

What is claimed is:

1. An interlocking construction block comprising

A) two identical planar sides, each side having an inner surface and an outer surface, a first end, a second end, a top edge and a bottom edge, a longitudinal centerline extending between said first and second ends, and a transverse centerline extending between said top edge and said bottom edge, said first ends being co-planar with each other, said top edges being co-planar with each other and said second ends being co-planar with each other, said sides being parallel and spaced apart from each other, and each of said sides having a height measured between said top edge and said bottom edge along said side transverse centerline;

B) a double shoulder rabbet joint connection means for connecting one block to a superadjacent block and to a subadjacent block, said connection means including (1) a projection means on each of said block top edges, said projection means including two shoulders, and (2) a groove means on each of said block side bottom edges, said groove means including two shoulders that are identical in size and shape to said projection means shoulders;

C) a first web having a top end, a bottom end, a longitudinal centerline extending between said first web top end and said first web bottom end, a first end edge connecting said first web top end to said first web bottom end, a second end edge connecting said first web top end to said first web bottom end, said first web connecting said two sides together and being connected to said side inner surfaces, said first web having a width measured between said first web first and second end edges, said first web first end edge being spaced apart from said side first ends along said side longitudinal centerline by an offset distance, said first web bottom being spaced from said side bottom edge along said side transverse centerline by a distance equal to one-half said offset distance, said first web having a length measured along said first web longitudinal centerline equal to the height of said sides, and having said first web top end spaced above said side top edges by a distance equal to one-half said offset distance, said first web width being equal to said offset distance;

D) a second web having a top end, a bottom end, a longitudinal centerline extending between said second web top end and said second web bottom end, a first end edge connecting said second web top end to said second web bottom end, a second end edge connecting said second web top end to said second web bottom end, said second web connecting said two sides together and being connected to said side inner surfaces, said second web having a width measured between said second web first and second end edges, said second web first end edge being spaced apart from said side second ends along said side longitudinal centerline by said offset distance, said second web second end edge being spaced from said side second ends by a distance equal to said offset distance, said second web bottom being spaced from said side bottom edge along said side transverse centerline by a distance equal to said offset distance, said second web having a length measured along said second web longitudinal centerline equal to the height of said sides, and having said second web top end spaced above said side top edges by a distance equal to one-half said offset distance said second web width being equal to two times said offset distance; and E) a third web having a top end, a bottom end, a longitudinal centerline extending between said third web to end and said third web bottom end, a first end edge connecting said third web top end to said third web bottom end, a second end edge connecting said third web top end to said third web bottom end, said third web connecting said two sides together and being connected to said side inner surfaces, said third web having a width measured between said third web first and second end edges, said third web bottom being spaced from said side bottom edge along said side transverse centerline by a distance equal to said offset distance, said third web having a length measured along said third web longitudinal centerline equal to the height of said sides, and having said third web top end spaced above said side top edges by a distance equal to one-half said offset distance, said third web width being equal to three times said offset distance, said third web having one face thereof being spaced from said side first ends by a distance measured along the longitudinal centerline of a side equal to one-half of the total of the side length plus the offset distance and another face thereof spaced from said second ends by a distance measured along the longitudinal centerline of the side equal to one-half of the total of the side length minus the offset distance.

2. The interlocking block defined in claim 1 wherein said offset distance is equal to $\frac{3}{4}$ inch.

3. The interlocking block defined in claim 2 wherein said block width is equal to 5 inches.

4. The interlocking block defined in claim 3 wherein said side height is equal to 8 inches.

5. The interlocking block defined in claim 4 wherein said side length is equal to 16 inches.

6. The interlocking block defined in claim 4 wherein said side length is equal to 32 inches.

7. The interlocking block defined in claim 4 wherein said side length is equal to 48 inches.

8. The interlocking block defined in claim 1 wherein said block sides and webs are formed of pressed wood materials.

9. An interlocking corner construction block comprising

A) an L-shaped body having a long leg and a short leg, said long leg including (1) two identical planar sides, each side having an inner surface and an outer surface, a first end, a second end, a top edge and a bottom edge, a longitudinal centerline extending between said first and second ends, and a transverse centerline extending between said top end and said bottom end, said first ends being co-planar with each other, said top edges being co-planar with each other and said second ends being co-planar with each other, said sides being parallel and spaced apart from each other, and each of said sides having a height measured between said top edge and said bottom edge along said side transverse centerline;

(2) a double shoulder rabbet joint connection means for connecting block to a superadjacent block and to a subadjacent block, said connection means including (a) a projection means on each of said block side top edges, each projection element including two shoulders, and (b) a groove means on each of said block side bottom edges, said groove means including two shoulders that are identical in size and shape to said projection means shoulders;

(3) a first web having a top end, a bottom end, a longitudinal centerline extending between said first web top end and said first web bottom end, a first end edge connecting said first web top end to said first web bottom end, a second end edge connecting said first web top end to said fist web bottom end, said first web connecting said two sides together and being connected to said side inner surfaces, aid first web having a width measured between said first web first and second end edges, said first web first end edge being spaced apart form said side first ends along said side longitudinal centerline by an offset distance, said first web bottom being spaced form said side bottom edge along said side transverse centerline by a distance equal to one-half said offset distance, said first web having a length measured along said first web longitudinal centerline equal to the height of said sides, and having said first web top end spaced above said side top edges by a distance equal to one-half said offset distance, said first web width being equal to said offset distance;

(4) a second web having a top end, a bottom end, a longitudinal centerline extending between said second web top end and said second web bottom end, a first end edge connecting said second web top end to said second web bottom end, and second end edge connecting said second web top end to said second web bottom end, said second web connecting said two sides together and being connected to said side inner surfaces. said second web having a width measured between said second web first and second end edges, said second web first end edge being spaced apart from said side second ends along said side longitudinal centerline by two times said offset distance, said second web second end edge being spaced from said side second ends by a distance equal to one-half said offset distance, said second web bottom being spaced from said side bottom edge along said side transverse centerline by a distance equal to one-half said offset distance, said second web having a length measured along said second web longitudinal centerline equal to the height of said sides, and having said second web top end spaced above said side top edges by a distance equal to one half said offset distance, said second web width being equal to three time said offset distance;

(5) a third web having a top end, a bottom end, a longitudinal centerline extending between said third web top end and said third web bottom end, a first end edge connecting said third web top end to said third web bottom end, a second end edge connecting said third web top end to said third web bottom end, said third web connecting said two sides together and being connected to said side inner surfaces, said third web having a width measured between said third web first and second end edges, said third web bottom being spaced from said side bottom edge along said side transverse centerline by a distance equal to said offset distance, said third web having a length measured along said third web longitudinal centerline equal to the height of said sides, and having said third web top end spaced above said side top edges by a distance equal to one-half said offset distance, said third web width being equal to three times said offset distance, said third web having one face thereof being spaced from said side first ends by a distance equal to one-half of the total of the side length plus the offset distance and another face thereof spaced from said second ends by a distance measured along the longitudinal centerline of the side equal to one-half of the total of the side length minus the offset distance;

B) said short leg including (1) two identical planar sides, each side having an inner surface and an outer surface, a first end, a second end, a top edge and a bottom edge, a longitudinal centerline extending between said short leg first and second ends, and a transverse centerline extending between said short leg top end and said bottom end, said short leg first ends being co-planar with each other, said short leg top edges being co-planar with each other and said short leg second ends being co-planar with each other, said short leg sides being parallel and spaced apart from each other, and each of said short leg sides having a height measured between said short leg top edge and said short leg bottom edge along said short leg side transverse centerline;

(2) a double shoulder rabbet joint connection means including (a) a projection means on each of said short leg side top edges, said short leg projection means including two shoulders, and (b) a groove means on each of said short leg side bottom edges, said short leg groove means including two shoulders that are identical in size and shape to said short leg projection means shoulders;

(3) a first web having atop end, a bottom end, a longitudinal centerline extending between said short leg first web top end and said short leg first web bottom end, a fist end edge connecting said short leg first web top end to said short leg first web bottom end, a second end edge connecting said short leg first web top end to said short leg first web bottom end, said short leg first web connection said short leg two sides together and being connected to aid short leg side inner surfaces, said short leg first web having a width measured between said short leg first web first and second end edges, said short leg first web first end edge being co-planar with said short leg side first ends, said short leg first web bottom being spaced from said short leg side bottom edge along said short leg side transverse centerline by a distance equal to said offset distance, said short leg first web having a length measured along said short leg first web longitudinal centerline equal to the height of said short leg sides, and having said first web top end spaced above said short leg side top edges by a distance equal to one-half said offset distance, said short leg first web width being equal to three times said offset distance;

(4) a second web having a top end, a bottom end, a longitudinal centerline extending between said short leg second web top end and said short leg second web bottom end, a first end edge connecting said short leg second web top end to said short leg second web bottom end, a second end edge connecting said short leg second web top end to said short leg second web bottom end, said short leg second web connecting said short leg two sides together and being connected to said short leg side inner surfaces, said short leg second web having a width measured between said short leg second web first and second end edges, said short leg second web first end edge being spaced apart from said short leg side second ends along said side short leg longitudinal centerline by a distance equal to said offset distance, said short leg second web second end edge being spaced from said short leg side second ends by a distance equal to said offset distance, said short leg second web bottom being spaced from said short leg side bottom edge along said short leg side transverse centerline by a distance equal to none-half said offset distance, said short leg second web having a length measured along said second web longitudinal centerline equal to the height of said short leg sides, and having said short leg second web top end spaced above said short leg side top edges by a distance equal to one-half said offset distance, said short leg second web width being equal to two times said offset distance; and C) said short leg intersecting said long leg and forming a corner.

10. A plurality of interlocking construction blocks comprising

A) a first block as defined in claim 1;

B) at least two corner blocks as defined in claim 9; and

C) said first block being interconnected with said corner blocks.

11. The interlocking block defined in claim 1 further including a cap element, said cap element including a projecting means that is complementary to said block groove means and a groove means that is complementary to said block projection means so said cap fits onto said block.

* * * * *